US010724783B2

(12) United States Patent
Ertik et al.

(10) Patent No.: US 10,724,783 B2
(45) Date of Patent: Jul. 28, 2020

(54) HOUSEHOLD REFRIGERATOR WITH AN OPENING DEVICE FOR A DOOR OR DRAWER

(71) Applicant: BSH HAUSGERAETE GMBH, Munich (DE)

(72) Inventors: Mustafa Ertik, Tekirdag (TR); Stephan Kempfle, Ellzee (DE); Murat Soeguet, Tekirdag (TR)

(73) Assignee: BSH Hausergeraete GmbH, Munich (DE)

( * ) Notice: Subject to any disclaimer, the term of this patent is extended or adjusted under 35 U.S.C. 154(b) by 804 days.

(21) Appl. No.: 15/142,092

(22) Filed: Apr. 29, 2016

(65) Prior Publication Data

US 2016/0320119 A1 Nov. 3, 2016

(30) Foreign Application Priority Data

Apr. 29, 2015 (TR) ..... a 2015 05248

(51) Int. Cl.
*F25D 23/02* (2006.01)
*E05F 15/00* (2015.01)

(52) U.S. Cl.
CPC ..... *F25D 23/028* (2013.01); *E05F 15/00* (2013.01); *F25D 2700/04* (2013.01)

(58) Field of Classification Search
CPC .... E05F 15/00; F25D 23/028; F25D 2700/04; F25D 2323/02; A47B 88/453; A47B 88/457
See application file for complete search history.

(56) References Cited

U.S. PATENT DOCUMENTS 3,736,768 A * 6/1973 Harbour ..... F25D 23/003 62/289
2006/0087208 A1* 4/2006 Oh ..... F25D 25/025 312/402

(Continued)

FOREIGN PATENT DOCUMENTS

EP 2829812 A2 * 1/2015 ..... F25D 23/003
EP 2829812 A2 * 1/2015 ..... F25D 23/003
JP 2006138582 A * 6/2006 ..... F25D 23/003

OTHER PUBLICATIONS

English Translation of EP2829812.*
English Translation of EP2829812 (Year: 2018).*
English Translation of Hirai JP2006138582 (Year: 2019).*

*Primary Examiner* — Edward F Landrum
*Assistant Examiner* — Melodee Jefferson
(74) *Attorney, Agent, or Firm* — Laurence A. Greenberg; Werner H. Stemer; Ralph E. Locher

(57) ABSTRACT

A household refrigerator has a thermally insulated cabinet, a storage compartment intended to store food and/or beverages and contained within the cabinet, a refrigerant cycle intended for cooling the storage compartment, and a compressor compartment housing a compressor of the refrigerant cycle. The cabinet is mounted on top of the compressor compartment. The household refrigerator contains a door leaf pivotally hinged with respect to the cabinet for opening and closing the storage compartment or a bottom drawer located directly above the compressor compartment and intended for storing food and/or beverages. The bottom drawer is closed when pushed into the storage compartment and open when at least partly be pulled out of the storage compartment. The household refrigerator contains a device for opening the closed door leaf or for opening the closed bottom drawer, which is attached inside the compressor compartment.

16 Claims, 7 Drawing Sheets

(56) References Cited

U.S. PATENT DOCUMENTS

| | | | | |
|---|---|---|---|---|
| 2009/0056356 | A1* | 3/2009 | Kempte | F25D 19/02 62/259.1 |
| 2010/0101267 | A1* | 4/2010 | Jung | F25D 23/028 62/449 |
| 2011/0050065 | A1* | 3/2011 | Lee | E05B 17/0033 312/402 |
| 2014/0306596 | A1 | 10/2014 | Linke | |

* cited by examiner

HOUSEHOLD REFRIGERATOR WITH AN OPENING DEVICE FOR A DOOR OR DRAWER

CROSS-REFERENCE TO RELATED APPLICATION

This application claims the priority, under 35 U.S.C. § 119, of Turkish application TR 2015/05248, filed Apr. 29, 2015; the prior application is herewith incorporated by reference in its entirety.

BACKGROUND OF THE INVENTION

Field of the Invention

The invention relates to a household refrigerator which contains a thermally insulated cabinet, a storage compartment intended for storing foods and/or beverages and contained within the cabinet, and a refrigerant cycle including a compressor for cooling the storage compartment. The household refrigerator contains a door leaf for closing and opening the storage compartment or a bottom drawer intended to be pushed into the storage compartment, and a device for opening the closed door leaf or the closed bottom drawer.

U.S. patent publication No. 2014/0306596 discloses a refrigerator. The refrigerator contains a thermally insulated body, an interior compartment for storing foods and beverages contained within the body, a door leaf moveably attached to the body and adapted for opening and closing the interior compartment, and a device for opening and/or closing the door leaf adapted to act on the door leaf. The device for opening and/or closing the door leaf is an integral module and is disposed in a corresponding pocket. The pocket is incorporated into an insulating layer of the body.

SUMMARY OF THE INVENTION

The object of the invention is to provide an improved household refrigerator which contains a device for opening a closed door leaf or a closed bottom drawer of the household refrigerator.

The object of the invention is achieved by a household refrigerator, containing a thermally insulated cabinet, a storage compartment intended to store foods and/or beverages and contained within the cabinet and a refrigerant cycle intended for cooling the storage compartment. The refrigerant cycle contains a compressor and a compressor compartment housing the compressor. The cabinet is mounted on top of the compressor compartment. A door leaf is pivotally hinged with respect to the cabinet for opening and closing the storage compartment. A device for opening the closed door leaf is provided, the device for opening the closed door leaf being attached inside the compressor compartment.

The storage compartment may be a fresh food compartment or a freezer compartment.

The household refrigerator contains the door leaf for opening and closing the storage compartment. The door leaf is pivotally hinged with respect to the cabinet in particular with respect to a vertical axis.

Alternatively or additionally, the household refrigerator may comprise a bottom drawer located directly above the compressor compartment and intended for storing the foods and/or beverages. The bottom drawer is closed when pushed into the storage compartment and open when at least partly be pulled out of the storage compartment. Then, the device for opening the closed door leaf is adapted to be a device for opening the closed bottom drawer.

The household refrigerator may contain an elastic magnetic seal which is attached to the surface of the door leaf facing towards the storage compartment. When the door leaf is closed, then the magnetic seal touches the cabinet. The bottom drawer may also be equipped with such an elastic magnetic seal.

The household refrigerator contains the refrigerant cycle. Refrigerant cycles per se are known in the art. The refrigerant cycle contains the compressor, a condenser, an expansion device and an evaporator.

The household refrigerator contains the compressor compartment. The cabinet is mounted on top of the compressor compartment. At least the compressor is placed within the compressor compartment. The compressor compartment may also house the condenser.

The household refrigerator may contain an electronic control device configured to control the refrigeration cycle as it is generally known in the art. The electronic control device may contain a microcontroller or a microprocessor and controls the refrigeration cycle, in particular its compressor such that the actual temperature of the storage compartment corresponds to a set value temperature. In order to control, in particular to feedback control the compressor, the household refrigerator may comprise at least one temperature sensor, coupled to the electronic control device and configured to measure the actual temperature of the storage compartment. The electronic control device may be placed within the compressor compartment.

The household refrigerator contains the device for opening the closed door leaf or for opening the closed bottom drawer. This device serves as a door opening assistant or as a bottom drawer opening assistant.

Preferably, the device for opening the closed door leaf or for opening the closed bottom drawer is attached within an upper half, or an upper third or an upper quarter of the compressor compartment inside the compressor compartment.

The device for opening the closed door leaf or for opening the closed bottom drawer may comprise a sensor adapted to sense if a person wants to open the closed door leaf or to open the closed bottom drawer, an actuator, a control device controlling the actuator in response to signals generated by the sensor, and a plunger. The actuator may be or comprise an electric motor and is adapted to move the plunger from a first position into a second position for opening the closed door leaf or the closed bottom drawer.

While the plunger is in its first position, the door leaf or the bottom drawer are able to remain closed. When moved from its first position to its second position, then the plunger pushes the closed door leaf or the closed bottom drawer open such that at least the magnetic seal, if applicable, detaches from the cabinet, allowing a person to completely open the door leaf or the bottom drawer more easily.

The sensor may be a pressure sensor which is coupled to the storage compartment and senses a change of air pressure inside the storage compartment caused by pushing or pulling at the closed door leaf or at the closed bottom drawer.

The device for opening the closed door leaf or for opening the closed bottom drawer may be configured as a module containing a housing which houses all or at least the essential parts of the device for opening the closed door leaf or for opening the closed bottom drawer. The essential parts may be the sensor adapted to sense if a person wants to open the closed door leaf or to open the closed bottom drawer, the actuator, the control device controlling the actuator in response to signals generated by the sensor, and the plunger.

The device for opening the closed door leaf or for opening the closed bottom drawer may be attached within the compressor compartment such that the plunger is located within an upper half, particularly within an upper third and preferably within an upper quarter of the compressor compartment inside the compressor compartment. By locating the device for opening the closed door leaf or for opening the closed bottom drawer as close as possible to the door leaf or to the bottom drawer, the plunger may better contact the door leaf or the drawer, respectively.

The compressor compartment houses the device for opening the closed door leaf or for opening the closed bottom drawer. Since the device for opening the closed door leaf or for opening the closed bottom drawer is attached within the compressor compartment and not within the thermally insulated cabinet, the thermal insulation of the cabinet is not affected by the device for opening the closed door leaf or for opening the closed bottom drawer.

The compressor compartment may contain two side wall sections, a rear wall section, a bottom wall section, and a front wall section. These sections may all be made from metal, preferably are metal sheets. The compressor compartment may include a ceiling wall section preferably made from metal. The compressor compartment may also be open at its top.

The front wall section may include air vents.

If the compressor compartment contains the front wall section, then the device for opening the closed door leaf or for opening the closed bottom drawer may be attached within the compressor compartment behind the front wall section, hiding this device.

The device for opening the closed door leaf or for opening the closed bottom drawer may, for instance, be attached to one of the side wall sections. The device for opening the closed door leaf or for opening the closed bottom drawer may be attached to the rear wall section, or may be attached to the bottom wall section. The compressor compartment may also comprise a ceiling or upper wall section. Then, the device for opening the closed door leaf or for opening the closed bottom drawer may be attached to that wall section. The side wall sections, the rear wall section, the bottom wall section, the front wall section and the ceiling wall section may be designed as relatively rigid components, and thus may be designed to handle forces applied by the device for opening the closed door leaf or for opening the closed bottom drawer relatively well.

The compressor compartment may comprise a carrier located inside the compressor compartment. Then, the device for opening the closed door leaf or for opening the closed bottom drawer may be attached to the carrier. By utilizing the carrier, the device for opening the closed door leaf or for opening the closed bottom drawer may be attached more flexibly within the compressor cabinet. The carrier may be a separate element with respect to side wall sections, a rear wall section, a bottom wall section, a ceiling wall section or a front wall section of the compressor compartment. The carrier may be a plate shaped element.

The carrier may be located in the middle, i.e. centrally with respect to the two side wall sections. Then, the plunger of the device for opening the closed door leaf or for opening the closed bottom drawer may be centered with respect to the two side walls, allowing to fasten the door leaf by hinges either on the left side or on the right side of household refrigerator cabinet without relocating the device for opening the closed door leaf or for opening the closed bottom drawer.

The compressor compartment may comprise a divisional wall section as the carrier preferably reaching up to the front wall section, wherein the device for opening the closed door leaf or for opening the closed bottom drawer is attached to the divisional wall section. The divisional wall section may be made from metal and is preferably a metal sheet.

The divisional wall section may be orientated vertically or horizontally.

The divisional wall section may divide the compressor compartment into a first sub-compartment and a second sub-compartment. The first sub-compartment and the second sub-compartment may be located on top of each other. Preferably, the first sub-compartment and the second sub-compartment may be located side-by-side. If the two sub-compartments are located side-by-side, then the divisional wall section may be located in the middle between the two side wall sections, i.e. located centrally with respect to the compressor compartment.

The divisional wall section may extend from one of the side wall sections to the other side wall section, or may extend from a bottom wall of the compressor compartment to a ceiling wall section of the compressor compartment. Then, the side wall section may be fastened to both side wall sections, or to the bottom wall section and to the ceiling wall section, resulting in an improved attachment of the side wall section to remaining components of the compressor compartment. Then the division wall section may handle forces applied by the device for opening the closed door leaf or for opening the closed bottom drawer relatively well.

The divisional wall section may reach up to the rear wall section. Alternatively, the divisional wall section may leave an opening between the divisional wall section and the rear wall section. The opening allows an airflow between the first sub-compartment and the second sub-compartment.

The divisional wall section may comprise a first wall section reaching up to the front wall section and a second wall section reaching up to the rear wall section. Then, the device for opening the closed door leaf or for opening the closed bottom drawer is attached to the first wall section of the divisional wall section. The first and second wall sections are preferably metal sheets.

The second wall section of the divisional wall section may comprise an aperture allowing an airflow between the first sub-compartment and the second sub-compartment.

The carrier, the divisional wall section or at least the first wall section of the divisional wall section may be detachably attached to the compressor compartment and may be accessible from the front of the compressor compartment for detaching and attaching the carrier, the divisional wall section or at least the first wall section of the divisional wall section, respectively. This embodiment allows a relatively simple replacement of the device for opening the closed door leaf or for opening the closed bottom drawer when the household refrigerator is completely assembled.

The carrier, the divisional wall section or at least the first wall section of the divisional wall section may be attached to the compressor compartment by fastening rails. The fastening rails may contain grooves and the carrier, the divisional wall section or at least the first wall section of the divisional wall section may contain edgefolds interacting with the grooves.

The divisional wall section may be fixed to the bottom wall section by a first fastening rail. A second fastening rail may be provided for additional fixing the first wall section to the second wall section. The second fastening rail may also be used for attaching the cabinet to the compressor compartment. Due to the fasting rails it is possible to move the divisional wall section on the rails, providing improved flexibility during assembling the household refrigerator.

The carrier, the divisional wall section or at least the first wall section of the divisional wall section may be fixed to the compressor compartment by at least two screws or a single screw. Preferably, the carrier, the divisional wall section or at least the first wall section of the divisional wall section, respectively, is fixed to a bottom wall section of the compressor compartment by the single screw, allowing a faster assembly of the household refrigerator.

In order to improve the airflow between the first sub-compartment and the second sub-compartment, the household refrigerator may contain a fan intended to generate a forced airflow between the first sub-compartment and the second sub-compartment. Particularly, the fan may be located at the aperture of the second wall section of the divisional wall section, i.e. the second wall section serves as a frame for the fan or the second wall section contains the fan.

Depending on the embodiment of the household refrigerator, a sheet metal base, the divisional wall section of the compressor compartment, is used to provide a supporting and fixation surface for the device for opening the closed door leaf or for opening the closed bottom drawer.

The purpose of the device for opening the closed door leaf or for opening the closed bottom drawer is to assist a person to open the closed door leaf or the closed bottom drawer. The device for opening the closed door leaf or for opening the closed bottom drawer may be an electro-mechanical device which is preferably activated by an air pressure deviation inside the storage compartment. Any air pressure change inside the storage compartment caused by pulling or pushing at the closed door leaf or bottom drawer may activate the device for opening the closed door leaf or for opening the closed bottom drawer.

Preferably, the device for opening the closed door leaf or for opening the closed bottom drawer is attached to the divisional wall preferably as its pin aligned with the center axis of the compressor compartment. By locating the device for opening the closed door leaf or for opening the closed bottom drawer on the middle of the compressor compartment, any force differentiation caused by door hinge side may be alleviated or even been avoided.

Other features which are considered as characteristic for the invention are set forth in the appended claims.

Although the invention is illustrated and described herein as embodied in a household refrigerator, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
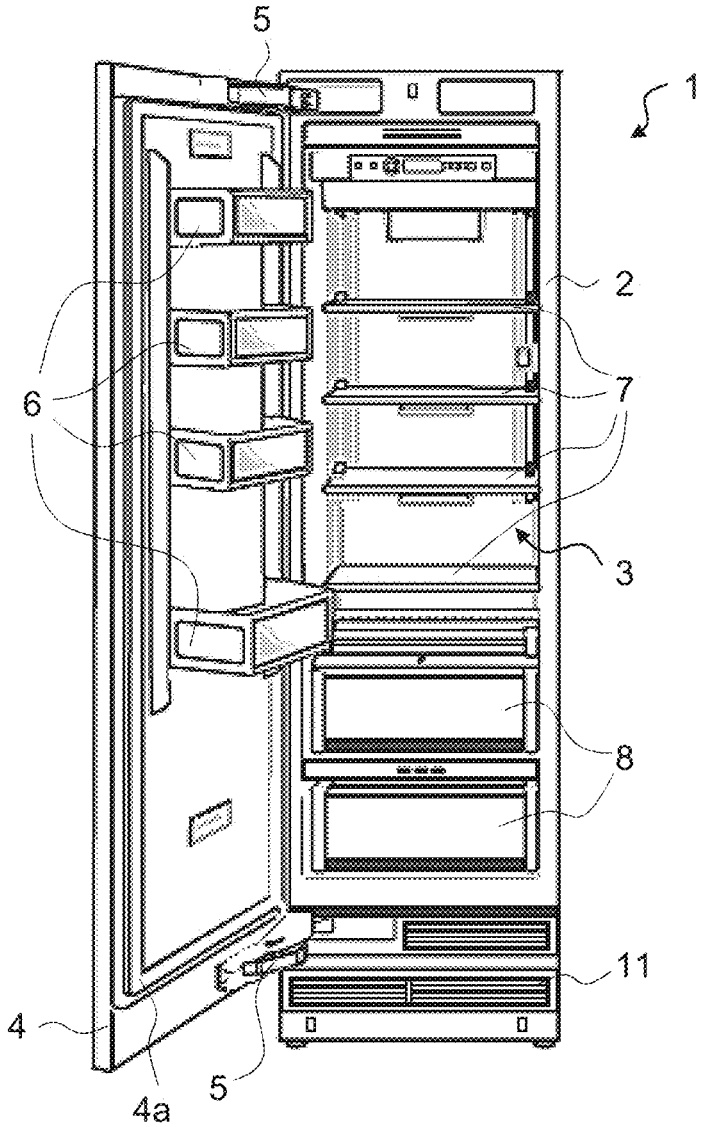
FIG. 1 is a perspective view of a household refrigerator containing a first compressor compartment according to the invention.

Referring now to the figures of the drawings in detail and first, particularly to FIG. 1 thereof, there is shown a household refrigerator 1 containing a thermally insulated cabinet or housing 2. Disposed within the cabinet 2 is a storage compartment 3 intended for storing foods and/or beverages.

The household refrigerator 1 contains a thermally insulated door leaf 4 for opening and closing the storage compartment 3. The door leaf 4 is pivotally hinged with respect to the cabinet 2 in particular with respect to a vertical axis and in particular by hinges 5. When the door leaf 4 is open, as shown in FIG. 1, then the storage compartment 3 is accessible.

The household refrigerator 1 contains magnetic seal **4*a* which is attached to the surface of the door leaf 4 facing towards the storage compartment 3. When the door leaf 4 is closed, then the magnetic seal 4*a* touches the cabinet 2. The magnetic seal 4*a*** is elastic.

The household refrigerator 1 may contain several door shelves 6 arranged on the surface of the door leaf 4 facing towards the storage compartment 3.

The household refrigerator 1 may contain, as shown in FIG. 1, several shelves 7 disposed on top of each other within the storage compartment 3, and drawers 8 disposed within and at the bottom of the storage compartment 3.

Figure 2:
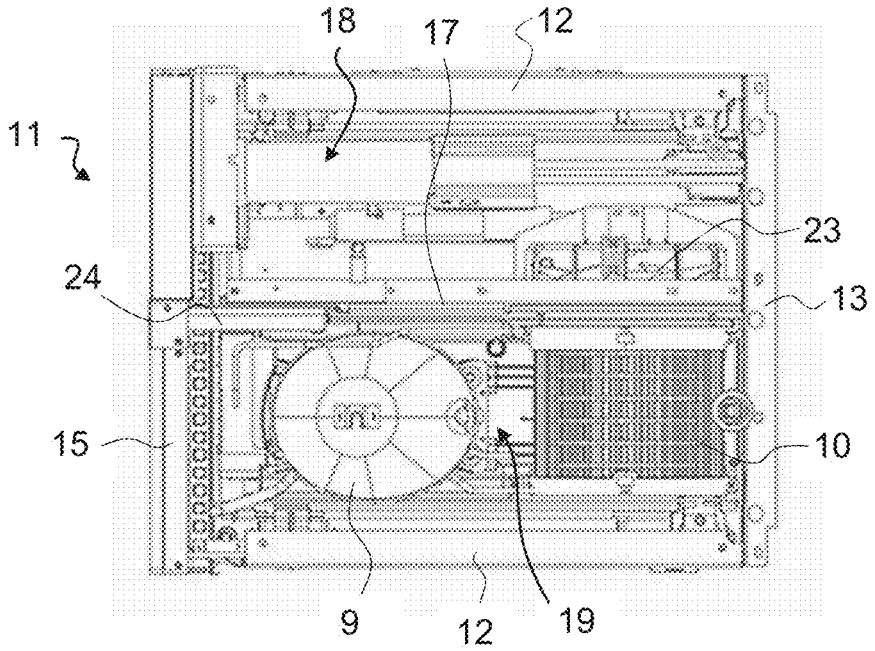
FIG. 2 is a top view of the first compressor compartment.

The household refrigerator 1 contains a refrigerant cycle for cooling the storage compartment 3. The refrigerant cycle contains, as it is generally known in the art, a compressor 9, a condenser 10, an expansion device and an evaporator. The compressor 9 and the condenser 10 are depicted in FIG. 2.

The household refrigerator 1 contains a first compressor compartment 11. FIG. 2 shows a top view of the first compressor compartment 11. The compressor 9 is placed within the first compressor compartment 11. The condenser 10 may also be placed within the first compressor compartment 11.

Figure 3:
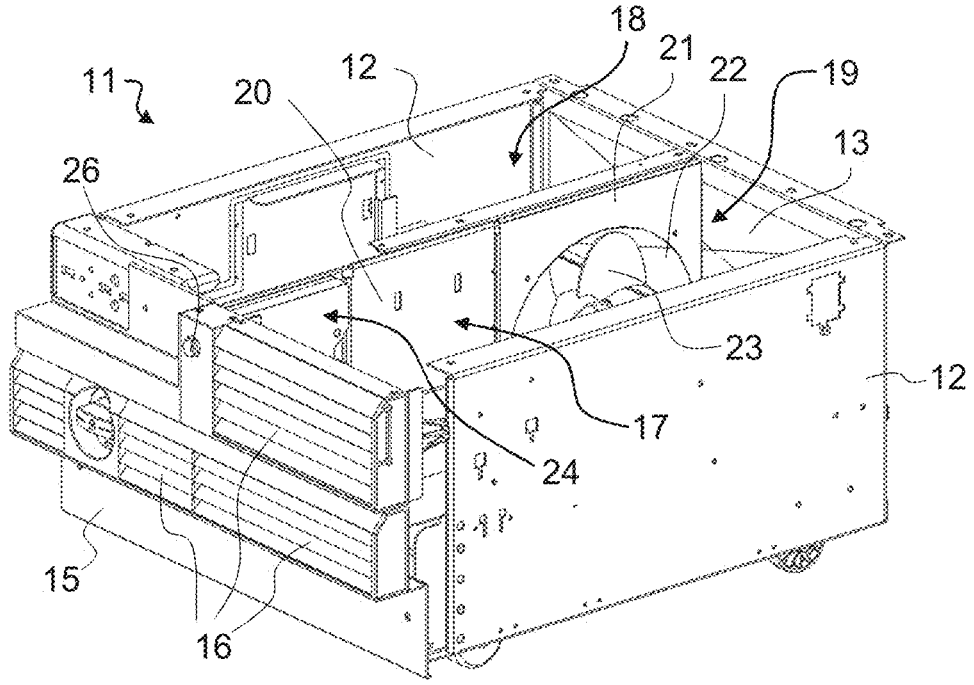
FIGS. 3 and 4 are perspective views of the first compressor compartment.
Figure 4:
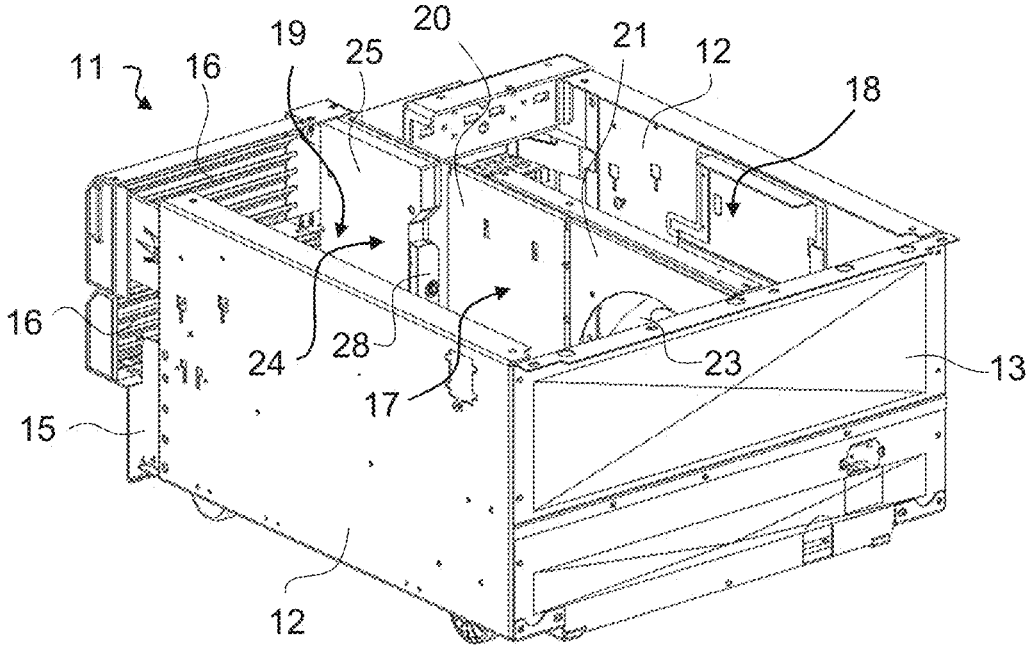
Figure 5:
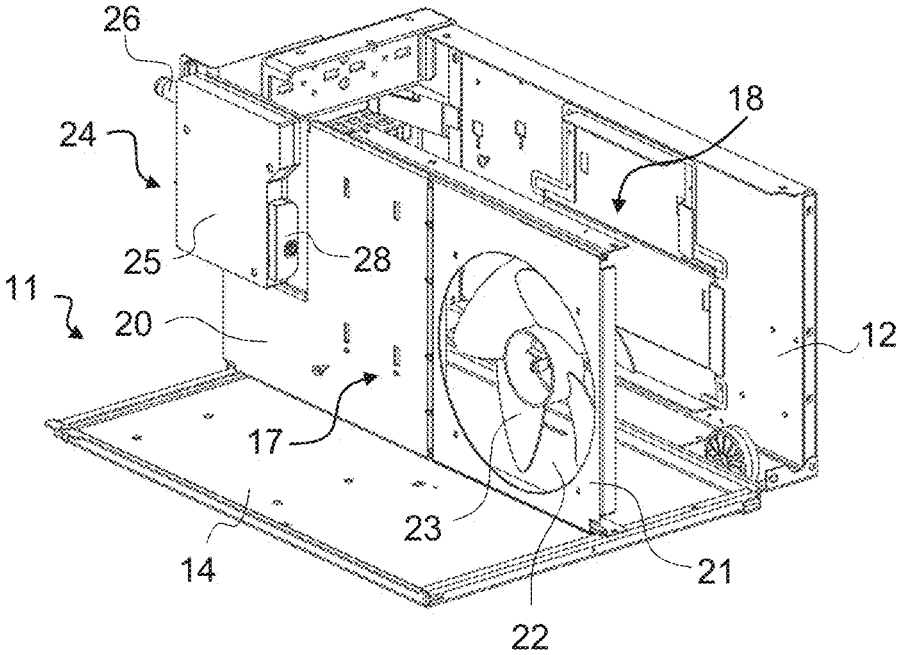
FIGS. 5 and 6 are perspective views of parts of the first compressor compartment.
Figure 6:
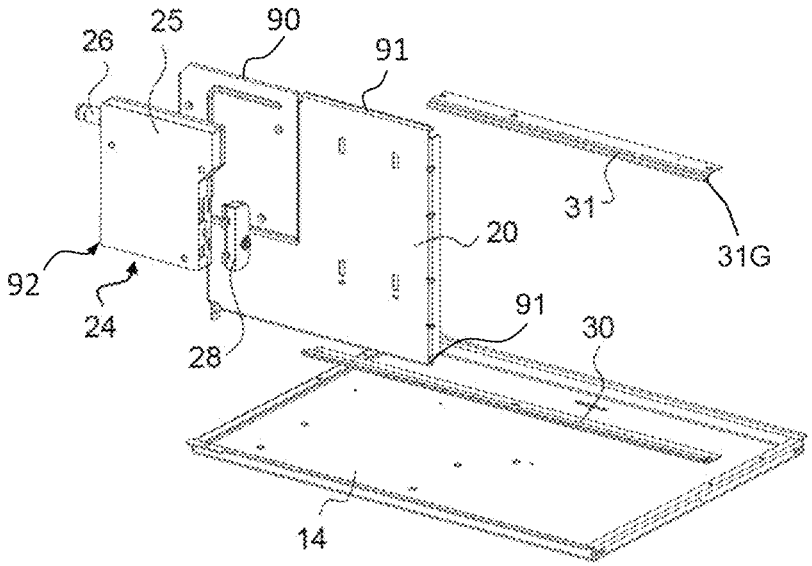

FIGS. 3 and 4 show perspective views of the first compressor compartment 11 without the compressor 9 and the condenser 10 and FIGS. 5 and 6 show perspective views of parts of the first compressor compartment 11.

The cabinet 2 is mounted on top of the first compressor compartment 11. In particular, the first compressor compartment 11 may be open towards the cabinet 2.

The first compressor compartment 11 contains two side wall sections 12, a rear wall section 13, a bottom wall section 14, and a front wall section 15. The side wall sections 12, the rear wall section 13 and the bottom wall section 14 may be made from metal and preferably are metal sheets. The front wall section 15 may be made from metal and includes air vents 16 to allow an air circulation between the interior of the first compressor compartment 11 and the surrounding of the household refrigerator 1. The compressor compartment 11 may include a ceiling wall section preferably made from metal.

The side wall sections 12 may be covered by appropriate covers not shown in the figures.

The household refrigerator 1 contains an electronic control device which is configured to control the refrigeration cycle as it is generally known in the art. The electronic control device may comprise a microcontroller or a microprocessor and controls the refrigeration cycle, in particular its compressor 9 such that the actual temperatures of the storage compartment 3 corresponds to a set value temperature. In order to control, in particular to feedback control the compressor 9, the household refrigerator 1 may comprise at least one temperature sensor not explicitly shown in the figures, coupled to the electronic control device and configured to measure the actual temperature of the storage compartment 3. The electronic control device may be placed within the first compressor compartment 11.

The first compressor compartment 11 may comprise a first divisional wall section 17 which divides the first compressor compartment 11 in a first sub-compartment 18 and a second sub-compartment 19. The first divisional wall section 17 is preferably made from metal and is in particular a metal sheet. The first sub-compartment 18 and the second sub-compartment 19 are placed side-by-side and both are limited by the front wall section 15 and the rear wall section 13.

For the example embodiment shown, the compressor 9 and the condenser 10 are placed within the second sub-compartment 19 and the electronic control device is placed within the first sub-compartment 18.

The first divisional wall section 17 may comprise a first wall section 20 and a second wall section 21. The first wall section 20 reaches up to the front wall section 15 and the second wall section 21 reaches up to the rear wall section 13.

The first divisional wall section 17, preferably the second wall section 21 may comprise an aperture 22 which allows an airflow between the first sub-compartment 18 to the second sub-compartment 19.

The first compressor compartment 11 may comprise a fan 23 which is placed at the aperture 22 to increase an air circulation between the first sub-compartment 18 and the second sub-compartment 19. The fan 23 is controlled by the electronic control device. Consequently, the second wall section 21 serves as a frame for the fan 23 or the second wall section 21 comprises the fan 23.

When operating, the fan 23 forces an airflow from the surrounding of the household refrigerator 1 through the air vents 16 into the first sub-compartment 18, from the first sub-compartment 18 through the aperture 22 into the second sub-compartment 19 and from the second sub-compartment 19 through the air vents 16 to the surrounding of the household refrigerator 1.

Figure 7:
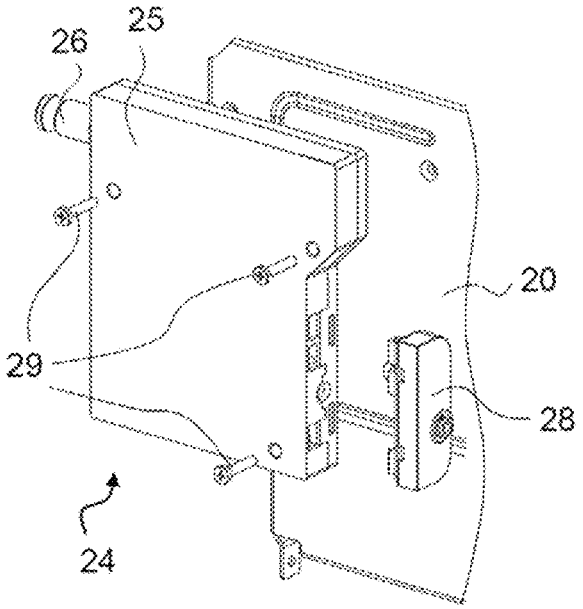
FIG. 7 is a perspective view of a device of opening a door leaf of the household refrigerator.

The household refrigerator 1 contains a device 24 for opening the closed door leaf 4. The device 24 for opening the closed door leaf 4 is also shown in FIG. 7.

The device 24 for opening the closed door leaf 4 is configured as a module 92 and contains a housing 25 which houses all or at least the essential parts 93 of the device 24 for opening the closed door leaf 4.

The device 24 for opening the closed door leaf 4 contains a sensor adapted to sense if a person wants to open the closed door leaf 4, an actuator 95, a control device 94 controlling the actuator in response to signals generated by the sensor 96, and a plunger 26.

The sensor may be a pressure sensor which is coupled to the storage compartment 3 and senses a change of air pressure inside the storage compartment 3 caused by pushing or pulling at the closed door leaf 4.

The actuator is adapted to move the plunger 26 from a first position into a second position. While the plunger 26 is in its first position, the door leaf 4 is able to remain closed. When moved from its first position to its second position, the plunger 26 pushes the closed door leaf 4 such that at least the magnetic seal 4*a* detaches from the cabinet 2, allowing a person to completely open the door leaf 4 more easily.

The plunger 26 may be moved automatically by the actuator from its second position to its first position or the plunger 26 may be moved from its second position to its first position by the door leaf 4 while being closed.

For the example, in the embodiment shown in FIG. 4, the device 24 for opening the closed door leaf 4 contains a connector plate 28 which can be detached and attached to the housing 25 and which contains electrical connections for the components of the device 24 for opening the closed door leaf 4.

The device 24 for opening the closed door leaf 4 may be attached to the first divisional wall section 17, preferably to the first wall section 20 by screws 29. The device 24 for opening the closed door leaf 4 or for opening the closed bottom drawer 8 may be attached to a carrier 90. Fastening rails 30, 31 may contain grooves 31G and the carrier 90, the divisional wall section or at least the first wall section of the divisional wall section 17 may contain edgefolds 91 interacting with the grooves 31G The first divisional wall section 17 may be attached to the bottom wall section 14 by a first fastening rail 30. A second fastening rail 31 may be provided for additional fixing the first wall section 20 to the second wall section 21. The second fastening rail 31 may also be used for attaching the cabinet 2 to the first compressor compartment 11. The first wall section may be fixed to the compressor compartment 11, preferably to the bottom wall section 14 by a single screw.

Preferably, the device 24 for opening the closed door leaf 4 is centrally attached to or within the first compressor compartment 11, in particular such that the plunger 26 is able to touch the surface of the door leaf 4 facing towards the storage compartment 3 centrally. Therefore, the first divisional wall section 17 is located centrally within the first compressor compartment 11 for the example embodiment shown.

Figure 8:
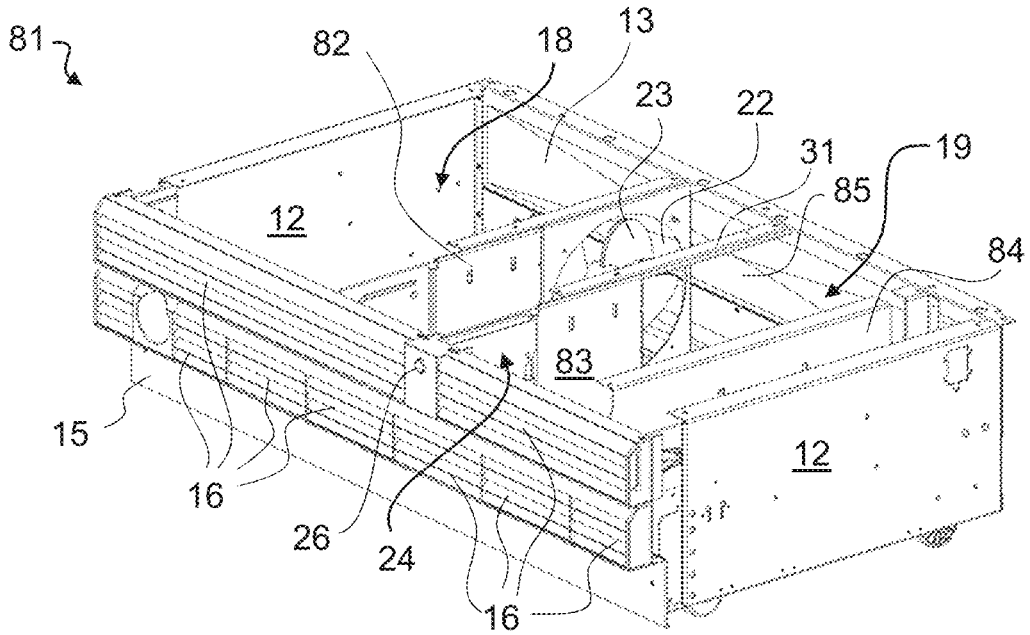
FIG. 8 is a perspective view of a second compressor compartment of a household refrigerator.

FIG. 8 shows a second compressor compartment 81 of another household refrigerator not explicitly shown. Components of the second compressor compartment 81 which serve the same function as components of the first compressor compartment 11 are denoted by the same reference signs.

The second compressor compartment 81 is wider than the first compressor compartment 11 and contains instead of the first divisional wall section 17 a second divisional wall section 82, a third divisional wall section 83 and a fourth divisional wall section 84. The second divisional wall section 82, the third divisional wall section 83 and the fourth divisional wall section 84 are preferably made from metal and are in particular metal sheets.

Similar to the first divisional wall section 17, the second divisional wall section 82 or the third divisional wall section 83 divide the second compressor compartment 81 into the first sub-compartment 18 and the second sub-compartment 19. The electronic control device, which is not shown in FIG. 8, is placed within the first sub-compartment 18 and the compressor 9 and the condenser 10 are placed within the second sub-compartment 19. The compressor 9 and the condenser 10 are not shown in FIG. 8.

The second divisional wall section 82 contains the aperture 22 at which the fan 23 is located.

The second divisional wall section 83 reaches from the front wall section 15 and leaves an opening 85 near the rear wall section 13.

The device 24 for opening the closed door leaf 4 is attached to the third divisional wall section 83 preferably by the screws 29.

Figure 9:
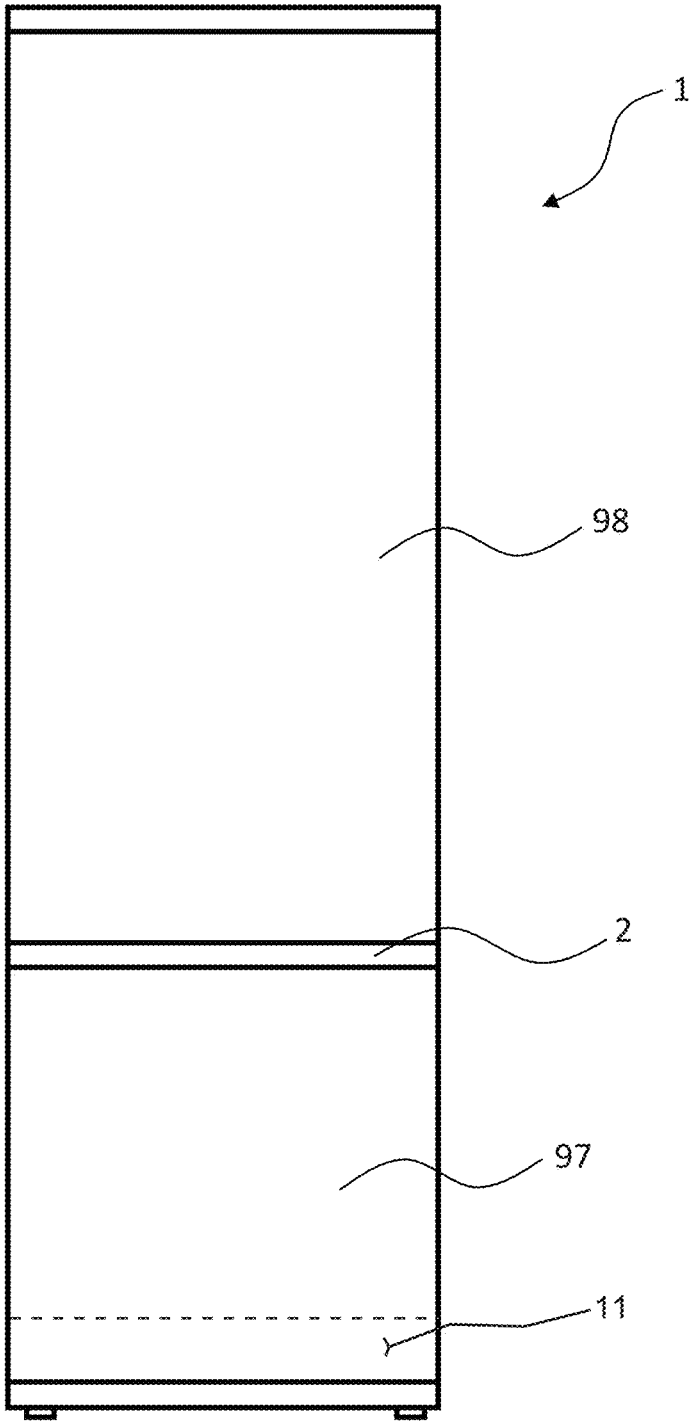
FIG. 9 is a front view of a household refrigerator according to a further embodiment of the invention.
Figure 10:
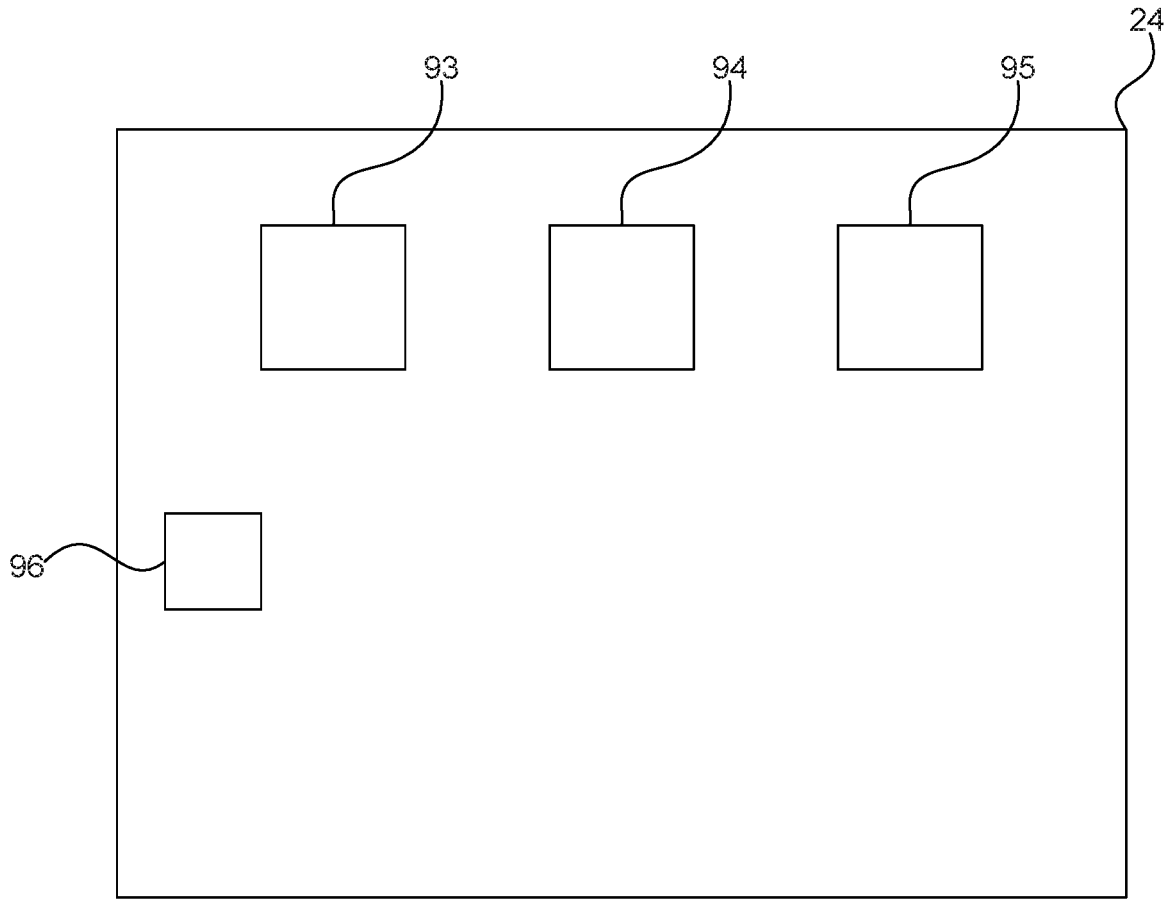
FIG. 10 is a schematic view of the device for opening.

Alternatively, the household refrigerator 1 may comprise a bottom drawer 97 and a door leaf 98 as shown in FIG. 9. The bottom drawer 97 can be pushed inside the storage compartment 3 in order to close the bottom drawer 97. The bottom drawer 97 is intended to store foods and/or beverages. In order to fill the bottom drawer 97 with the foods and/or beverages or to remove the foods and/or beverages, the bottom drawer 97 can be at least partly be pulled out of the storage compartment 3. Then, the device 24 for opening the closed door leaf 4 may be adapted to be a device for opening the closed bottom drawer 97.

The following is a summary list of reference numerals and the corresponding structure used in the above description of the invention:

1 household refrigerator
2 cabinet
3 storage compartment
4 door leaf
4*a* magnetic seal
5 hinges
6 door shelves
7 shelves
8 drawer
9 compressor
10 condenser
11 first compressor compartment
12 side wall sections
13 rear wall section
14 bottom wall section
15 front wall section
16 air vents
17 first divisional wall section
18 first sub-compartment
19 second sub-compartment
20 first wall section
21 second wall section
22 aperture
23 fan
24 device for opening the closed door leaf
25 housing
26 plunger
28 connector plate
29 screws
30 first fastening rail
31 second fastening rail
81 second compressor compartment
82 second divisional wall section
83 third divisional wall section
84 fourth divisional wall section
85 opening

The invention claimed is:

1. A household refrigerator, containing:

a thermally insulated cabinet; a storage compartment for storing at least one of food or beverages and contained within said cabinet;

a refrigerant cycle for cooling said storage compartment, said refrigerant cycle including a compressor and a compressor compartment housing said compressor, said compressor compartment having a front wall section, and a divisional wall section, said divisional wall section reaching up to said front wall section and having a vertical extent dividing said compressor compartment into a first sub-compartment and a second sub-compartment, said divisional wall section having a carrier, said cabinet being mounted on top of said compressor compartment;

a surface having a closed position closing said storage compartment and being displaceable with respect to said cabinet for opening said storage compartment, said surface being perpendicular to said divisional wall section in said closed position, said surface being defined by a door leaf or by an exterior drawer; and an opening device acting on said surface for opening said surface from the closed position, said opening device being affixed on said divisional wall inside said compressor compartment, said opening device being attached to said carrier.

2. The household refrigerator according to claim 1, wherein said compressor compartment has two side wall sections and said divisional wall section is disposed centrally between said two side wall sections.

3. The household refrigerator according to claim 1, wherein said first sub-compartment and said second sub-compartment are disposed side-by-side.

4. The household refrigerator according to claim 3, further comprising a fan to generate a forced airflow between said first sub-compartment and said second sub-compartment.

5. The household refrigerator according to claim 1, wherein said compressor compartment has a rear wall section and said divisional wall section reaches up to said rear wall section.

6. The household refrigerator according to claim 1, wherein said carrier is detachably attached to said divisional wall section and is accessible from a front of said compressor compartment for attachment and detachment from said divisional wall.

7. The household refrigerator according to claim 1, further comprising fastening rails, said carrier is attached to said compressor compartment by said fastening rails.

8. The household refrigerator according to claim 7, wherein each of said fastening rails has a groove formed therein and said carrier has edge folds interacting with said grooves.

9. The household refrigerator according to claim 1, wherein said compressor compartment further has a rear wall section and said divisional wall section leaves an opening between said divisional wall section and said rear wall section.

10. The household refrigerator according to claim 1, wherein said opening device is configured as a module with a housing which houses parts of said opening device.

11. The household refrigerator according to claim 1, wherein said opening device has a sensor configured to sense when a person wants to displace said surface, an actuator, a control device that controls said actuator in response to signals generated by said sensor, and a plunger that acts on said surface, said actuator constructed to move said plunger from a first position into a second position to displace said surface and open said storage compartment.

12. The household refrigerator according to claim 1, wherein said opening device is attached within an upper half of said compressor compartment inside said compressor compartment.

13. A household refrigerator, containing:

a thermally insulated cabinet;

a storage compartment for storing at least one of food or beverages and contained within said cabinet;

a refrigerant cycle for cooling said storage compartment, said refrigerant cycle including a compressor and a compressor compartment housing said compressor, said compressor compartment having a rear wall section, a front wall section, and a divisional wall section, said divisional wall section having a first wall section reaching up to said front wall section and a second wall section reaching up to said rear wall section, and said divisional wall section having a vertical extent dividing said compressor compartment into a first sub-compartment and a second sub-compartment, said cabinet being mounted on top of said compressor compartment;

a surface having a closed position closing said storage compartment and being displaceable with respect to said cabinet for opening said storage compartment, said surface being perpendicular to said divisional wall section in said closed position, said surface being defined by a door leaf or by an exterior drawer;

and an opening device acting on said surface for opening said surface from the closed position, said opening device being affixed on said divisional wall inside said compressor compartment, said opening device being attached to said first wall section of said divisional wall section.

14. The household refrigerator according to claim 13, wherein said second wall section has an aperture formed therein to provide an airflow between said first sub-compartment and said second sub-compartment.

15. A household refrigerator, containing:

a thermally insulated cabinet;

a storage compartment for storing at least one of food or beverages and contained within said cabinet;

a refrigerant cycle for cooling said storage compartment, said refrigerant cycle including a compressor and a compressor compartment housing said compressor, said compressor compartment having a front wall section, and a divisional wall section, said divisional wall section reaching up to said front wall section and having a vertical extent dividing said compressor compartment into a first sub-compartment and a second sub-compartment, said cabinet being mounted on top of said compressor compartment;

a surface having a closed position closing said storage compartment and being displaceable with respect to said cabinet for opening said storage compartment, said surface being perpendicular to said divisional wall section in said closed position, said surface being defined by a door leaf or by an exterior drawer; and an opening device acting on said surface for opening said surface from the closed position, said opening device being affixed on said divisional wall inside said compressor compartment, said opening device being attached within said compressor compartment with a plunger disposed within an upper half of said compressor compartment inside said compressor compartment.

16. A household refrigerator, containing:

a thermally insulated cabinet;

a storage compartment for storing at least one of food or beverages and contained within said cabinet;

a refrigerant cycle for cooling said storage compartment, said refrigerant cycle including a compressor and a compressor compartment housing said compressor, said compressor compartment having a front wall section, and a divisional wall section, said divisional wall section reaching up to said front wall section and having a vertical extent dividing said compressor compartment into a first sub-compartment and a second sub-compartment, said cabinet being mounted on top of said compressor compartment;

a surface having a closed position closing said storage compartment and being displaceable with respect to said cabinet for opening said storage compartment, said surface being perpendicular to said divisional wall section in said closed position, said surface being defined by a door leaf or by an exterior drawer; and an opening device acting on said surface for opening said surface from the closed position, said opening device being affixed on said divisional wall inside said compressor compartment, said opening device is attached within said compressor compartment behind said front wall section.

* * * * *